US008776752B2

(12) United States Patent
Kimura

(10) Patent No.: US 8,776,752 B2
(45) Date of Patent: Jul. 15, 2014

(54) STARTER

(75) Inventor: Motoaki Kimura, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 281 days.

(21) Appl. No.: 13/267,387

(22) Filed: Oct. 6, 2011

(65) Prior Publication Data

US 2012/0234280 A1 Sep. 20, 2012

(30) Foreign Application Priority Data

Mar. 16, 2011 (JP) ..... 2011-058261

(51) Int. Cl.
*F02N 15/02* (2006.01)

(52) U.S. Cl.
USPC ..... 123/179.25; 74/6

(58) Field of Classification Search
USPC ..... 123/179.1, 179.25, 185.1, 185.5, 185.6, 123/185.8, 185.9, 185.11; 74/6, 7 C, 7 E
See application file for complete search history.

(56) References Cited

U.S. PATENT DOCUMENTS 2,235,076 A * 3/1941 McGrath ..... 74/6
2,542,712 A * 2/1951 Schneider et al. ..... 290/38 A
3,965,754 A * 6/1976 Bowcott ..... 74/6
4,579,010 A * 4/1986 Colvin et al. ..... 74/7 A
5,167,162 A * 12/1992 Nagashima et al. ..... 74/7 A
7,654,163 B2 * 2/2010 Murase et al. ..... 74/7 A
7,980,150 B2 * 7/2011 Hasegawa et al. ..... 74/7 E
2007/0137325 A1 6/2007 Murase et al.

FOREIGN PATENT DOCUMENTS

JP 63186964 A 8/1988
JP 05052167 A 3/1993
JP 06066234 A 3/1994
JP 2007-085317 A 4/2007
JP 2007085317 A 4/2007

OTHER PUBLICATIONS

Japanese Office Action issued Mar. 5, 2013, Patent Application No. 2011-058261.

* cited by examiner

*Primary Examiner* — Hai Huynh
(74) *Attorney, Agent, or Firm* — Sughrue Mion, PLLC

(57) ABSTRACT

A starter includes a shift lever that is engaged between a washer and a space collar and moves an output shaft in an axial direction, and a locking portion that is disposed between a snap ring attached to the output shaft and the shift lever to be movable on the output shaft and locks at least a part of an outer circumference portion of the snap ring when the shift lever is engaged between the washer and the space collar. An axial length of the locking portion is shorter than an axial movable length of the locking portion when the snap ring is attached to or removed from the output shaft and longer than the axial movable length of the locking portion when the shift lever is engaged between the washer and the space collar.

7 Claims, 4 Drawing Sheets

STARTER

BACKGROUND OF THE INVENTION

1. Field of the Invention

The present invention relates to a starter that starts an engine by pushing a pinion with a shift lever so that the pinion meshes with a ring gear of the engine.

2. Background Art

A structure often adopted by a starter of this type is as follows. That is, a lever device (shift lever) provided with a lever ring is swayed by exploiting a plunger attracting force of a magnet switch. A pinion provided integrally with a clutch shaft (output shaft) is then pushed in an axial direction by the lever ring and meshes with a ring gear to get the engine started. After the engine is started, the pinion is demeshed from the ring gear.

In order to start the engine, it is necessary to form the clutch shaft to be able to rotate at a high speed. Also, in order to allow the ring gear and the pinion to mesh with each other, it is necessary to form the clutch shaft to be movable in the axial direction and thereby become able to operate in association with an operation of the lever device including the lever ring. Further, in order to prevent displacement between the clutch shaft and the lever device, there is a case where the clutch shaft and the lever device are coupled to each other.

In this case, the starter adopts a fall-off preventing structure. More specifically, after components, such as the lever ring, a stop ring, and a washer, are attached to the clutch shaft, these components are fixed to the clutch shaft with a snap ring so as not to fall off (for example, Patent Document 1).

A C-type snap ring, which is a circular ring with a uniform peripheral rim width and having a notch, is used as the snap ring and serves as a retainer for the respective components when the engine is started normally. However, in a case where the pinion is not pushed back after the engine is started and the ring gear and the pinion remain in a meshed state, there occurs a phenomenon called an overrun that a motor rotates excessively due to rotations of the engine. In order to avoid this inconvenience, the starter of this type is provided with a one-way clutch. Nevertheless, it is still impossible to prevent an overrun at a predetermined region between the clutch and the pinion, that is, the clutch shaft to which the snap ring is attached, and the clutch shaft and the snap ring rotate at a high speed. Accordingly, an excessively large centrifugal force of the clutch shaft in a radially outward direction acts on the snap ring attached to the clutch shaft. As the clutch shaft rotates faster, the snap ring may possibly undergo deformation because of an increasing centrifugal force. When the centrifugal force exceeds fixing force of the snap ring, the snap ring may undergo expansion deformation to the extent that the snap ring falls off from the clutch shaft. As a result, the stop ring and the washer fall off from the clutch shaft. In a case where the lever device is unable to push the pinion provided integrally with the clutch shaft in the axial direction, the engine fail to start. In a case where the lever device is unable to demesh the pinion from the ring gear after the engine is started, the starter is damaged by the overrun. The starter in the related art therefore has a problem that the reliability is deteriorated considerably.

As a countermeasure to prevent a fall-off of the snap ring, the rim width of the snap ring may be increased to make the snap ring more rigid, so that the snap ring has not only the fixing force necessary to regulate the respective components attached to the clutch shaft in the axial direction but also the fixing force high enough to withstand the centrifugal force of the clutch shaft generated while the clutch shaft is rotating at a high speed. Another countermeasure may be to provide a holder that is fit onto the snap ring shown in FIG. 7 of Patent Document 1 from a radially outward direction to prevent the snap ring from undergoing deformation due to the centrifugal force, thereby making it possible to prevent a fall-off of the snap ring.

Patent Document 1: Japanese Patent No. 4375314

According to the former countermeasure to prevent a fall-off of the snap ring, however, because the snap ring is made more rigid by increasing the rim width thereof, a large force is necessary to attach or remove the snap ring when the starter is assembled or disassembled. The former countermeasure therefore has a problem that attaching and removing workability becomes poor. Meanwhile, the latter countermeasure requires an extra work to attach or remove the fall-off preventing holder when the starter is assembled or disassembled. The latter countermeasure therefore has a problem that attaching and removing workability of the snap ring becomes poor in comparison with a structure having no fall-off preventing holder.

SUMMARY OF THE INVENTION

The present invention was devised to solve the problems discussed above and provides a more reliable starter in which a snap ring can be attached or removed with ease when the starter is assembled or disassembled and a fall-off of the snap ring can be prevented in a reliable manner while the starter is operating.

A starter according to an aspect of the invention includes: a motor that generates a rotational force; an output shaft that rotates with the rotational force transmitted thereto; a snap ring that is fit in a locking groove provided to the output shaft in a circumferential direction; a first pressed body that is inhibited from moving in one axial direction by the snap ring; a second pressed body that defines a clearance portion together with the first pressed body by opposing the first pressed body in an axial direction; an engaging member that is engageable with and disengageable from the clearance portion after the snap ring is fit in the locking groove and includes at least a shift lever that moves the output shaft in the axial direction by pressing one of the first and second pressed bodies in the axial direction when engaged with the clearance portion; a pinion that meshes with a ring gear of an engine by moving in the axial direction integrally with the output shaft and starts the engine by rotating integrally with the ring gear; and a locking portion that is disposed between the snap ring and the shift lever to be movable on the output shaft and locks at least apart of an outer circumference portion of the snap ring when the engaging member is engaged with the clearance portion. An axial length of the locking portion is shorter than an axial movable length of the locking portion when the snap ring is fit in and removed from the locking groove and longer than the axial movable length of the locking portion when the engaging member is engaged with the clearance portion.

When configured as above, because the locking portion that locks the snap ring is movable to a position at which the locking portion does not lock the snap ring when the starter is assembled or disassembled, the snap ring can be attached and removed with ease. Also, because the locking portion functions while the starter is operating, a fall-off of the snap ring can be prevented in a reliable manner. It thus becomes possible to provide a more reliable starter.

The foregoing and other object, features, aspects, and advantages of the present invention will become more apparent from the following detailed description of the present invention when taken in conjunction with the accompanying drawings.

BRIEF DESCRIPTION OF THE DRAWINGS

FIG. 3A is a front view of the shift lever according to the first embodiment of the invention;

DESCRIPTION OF THE PREFERRED EMBODIMENTS

First Embodiment

Figure 1:
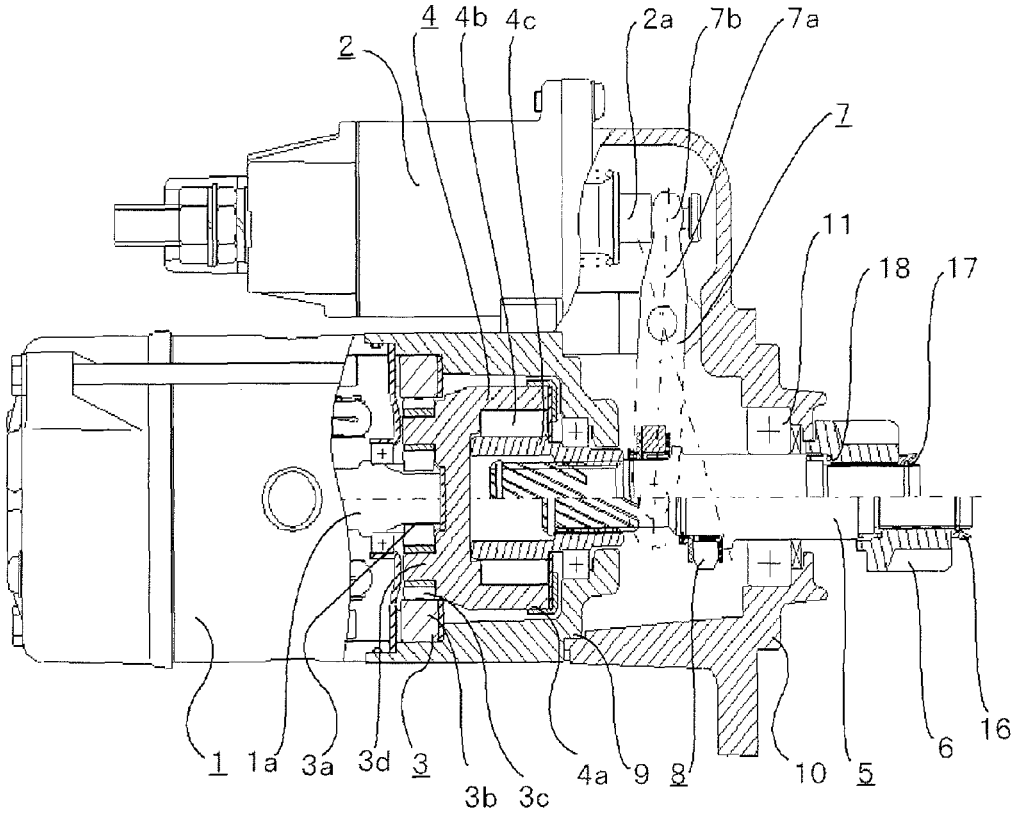
FIG. 1 is a cross section of a starter according to a first embodiment of the invention.
Figure 2:
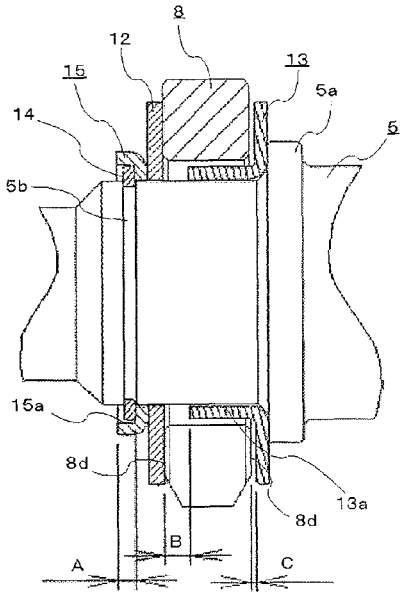
FIG. 2 is a cross section of a major portion after a shift piece is incorporated into the starter according to the first embodiment of the invention.
Figure 3A:
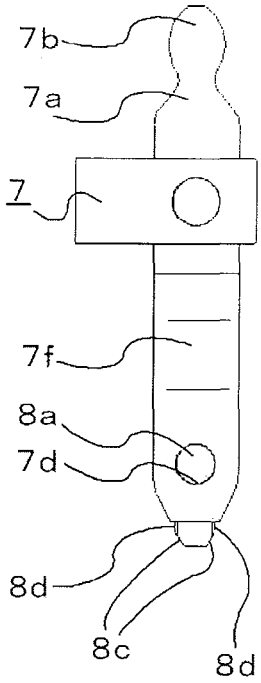
FIG. 3A is a side view of a shift lever according to the first embodiment of the invention.
Figure 3B:
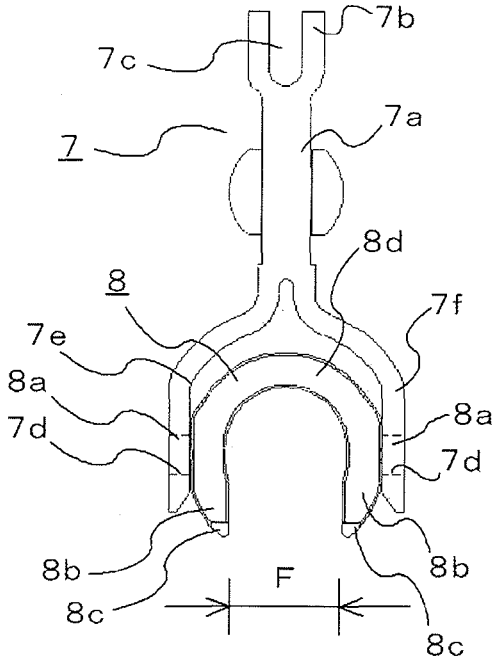
Figure 4A:
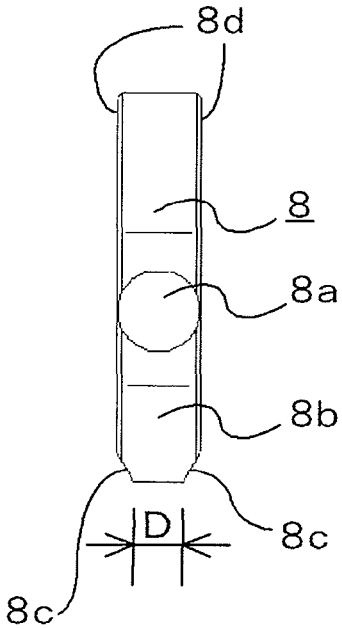
FIG. 4A is a side view of the shift piece according to the first embodiment of the invention.
Figure 4B:
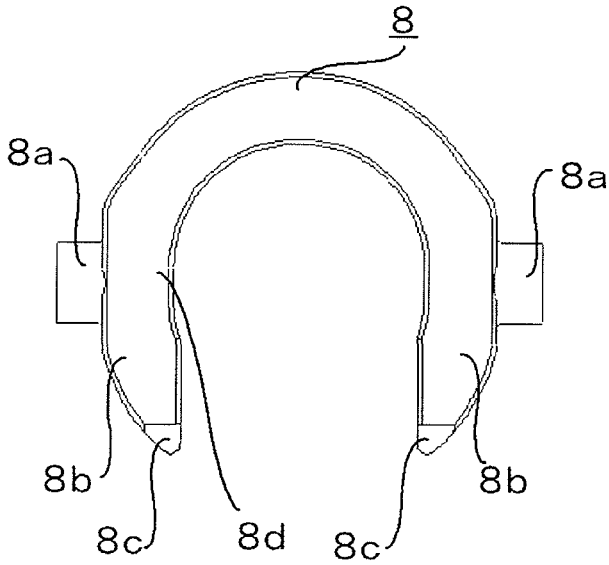
FIG. 4B is a front view of the shift piece according to the first embodiment of the invention.
Figure 5:
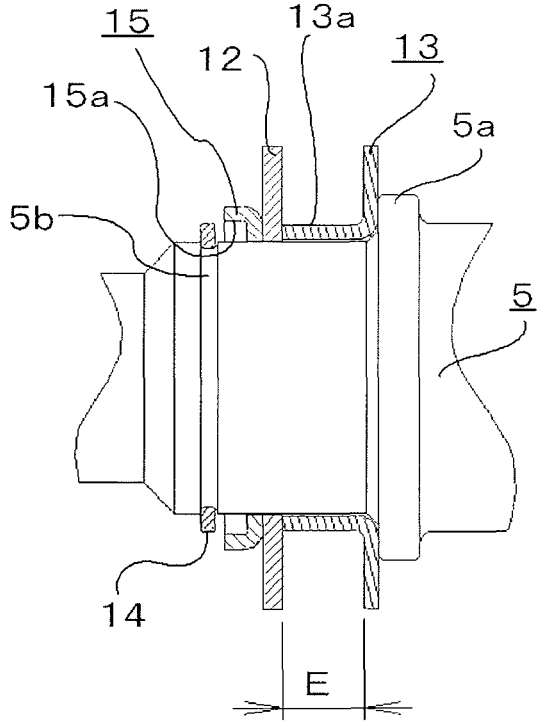
FIG. 5 is a cross section of a major portion before the shift piece is incorporated into the starter according to the first embodiment of the invention.

FIG. 1 is a cross section of a starter according to a first embodiment of the invention. FIG. 2 is a cross section of a major portion after a shift piece is incorporated into the starter of FIG. 1. FIG. 3A is a side view of a shift lever employed in the starter of FIG. 2. FIG. 3B is a front view of the shift lever of FIG. 3A. FIG. 4A is a side view of the shift piece employed for the shift lever of FIGS. 3A and 3B. FIG. 4B is a front view of the shift piece of FIG. 4A. FIG. 5 is a cross section of a major portion before the shift piece is incorporated into the starter of FIG. 1. Hereinafter, descriptions will be given by labeling like components with like reference numerals.

As is shown in FIG. 1, the starter of the first embodiment includes a motor 1, an electromagnetic switch 2 that switches ON and OFF a conduction state to the motor 1 according to an ON operation of an unillustrated key switch, a deceleration portion 3 that is meshed with a rotation shaft 1*a* of the motor 1, a clutch 4 to which a rotational force of the motor 1 is transmitted via the deceleration portion 3, an output shaft 5 that is fit to the clutch 4, a pinion 6 that is provided to the output shaft 5 and allowed to mesh with a ring gear (not shown) of an engine, a shift lever 7 that is swingably provided between the electromagnetic switch 2 and the output shaft 5, and a shift piece 8 that is provided to the shift lever 7 on the side of the output shaft 5. The deceleration portion 3 and the clutch 4 are contained in a center bracket 9. The center bracket 9, the output shaft 5, the shift lever 7, and the shift piece 8 are fixed to or contained in a front bracket 10. The electromagnetic switch 2 is fixed onto the front bracket 10. The pinion 6 is fixed at a tip end of the output shaft 5 protruding in an opening of the front bracket 10 on the side opposite to the motor 1.

Hereinafter, the respective components will be described. The deceleration portion 3 is a planetary gear deceleration device that reduces a rotational force generated by the motor 1. The planetary gear deceleration device 3 includes a sun gear 3*a*, an internal gear 3*b*, and a plurality of planetary gears 3*c*. The sun gear 3*a* is formed integrally with the rotation shaft 1*a* of the motor 1 at the tip end thereof. The internal gear 3*b* is fixed to the center bracket 9. The planetary gears 3*c* each are supported in a rotatable manner on a support shaft 3*d* firmly attached to the clutch 4. The planetary gears 3*c* decelerate the sun gear 3*a*, that is, the rotation shaft 1*a* as each meshes with the sun gear 3*a* and the internal gear 3*b* and revolves while rotating on its own axis.

The clutch 4 is a device that transmits a rotational force of the planetary gear deceleration device 3 to the output shaft 5 and also cuts off transmission of a rotational force by running idle when the rotational speed of the output shaft 5 exceeds the rotational speed of the planetary gear deceleration device 3. The clutch 4 includes a clutch outer 4*a*, a roller 4*b*, and a clutch inner 4*c*. The clutch outer 4*a* is supported on the planetary gear deceleration device 3 by means of the support axis 3*d*. A rotational force of the planetary gear deceleration device 3 transmitted to the clutch outer 4*a* is transmitted to the clutch inner 4*c* via the roller 4*b*.

The electromagnetic switch 2 is a device that generates a driving force to sway the shift lever 7. The electromagnetic switch 2 is provided with a plunger 2*a* that reciprocates in the axial direction due to a magnetic force.

The shift lever 7 is a member that swings with a driving force generated by the electromagnetic switch 2 to move the output shaft 5 in the axial direction. The shift lever 7 includes a lever 7*a* and the shift piece 8. The lever 7*a* is a Y-shaped member made, for example, of resin. At an end portion 7*b* on the side opposite to a fork portion, the lever 7*a* is provided with a groove 7*c* in which the lever 7*a* engages with an end of the plunger 2*a* of the electromagnetic switch 2. The lever 7*a* is also provided with a through-hole 7*d* in the side surface on the fork side. The shift piece 8 is a substantially U-shaped member opening at one end and made, for example, of resin. Two protrusions 8*a* are provided uniformly on the outer circumference side thereof. Further, the protrusions 8*a* on the outer circumference side are inserted into the through-hole 7*d* in the lever 7*a* to be fit therein and also supported in a rotatable manner on the fork legs 7*e* and 7*f* of the lever 7*a*, and the shift piece 8 is engaged with a clearance portion between pressed portions 12 and 13 provided to the output shaft 5 and described below.

The output shaft 5 is a substantially cylindrical member that moves in the axial direction as being pressed by the shift lever 7 and also rotates with a rotational force of the motor 1 transmitted thereto via the planetary gear deceleration device 3 and the clutch 4. An end portion of the output shaft 5 on the side of the motor 1 is helically splined to the clutch inner 4*c*. The other end portion of the output shaft 5 on the opposite side to the motor 1 is supported in a reciprocable and rotatable manner on the front bracket 10 via a bearing 11 while protruding to the outside of the front bracket 10. Further, the pressed portions 12 and 13 pressed by the shift lever 7 are disposed so as to define the clearance portion at the axial center of output shaft 5 located on the inner side of the front bracket 10. The shift piece 8 is engaged with this clearance portion. In the first embodiment, a washer is used as the pressed portion 12 and a space collar as the pressed portion 13.

As is shown in FIG. 2, the space collar 13 is a substantially ring-shaped member made of metal having a cylindrical portion 13*a*. The space collar 13 is threaded onto the output shaft 5 and locked with an axial regulation flange 5*a* provided to the output shaft 5. The washer 12 is a ring-shaped member made of metal and a movement thereof in the axial direction toward the motor 1 is regulated by a snap ring 14 fit in a locking groove 5*b* provided to the output shaft 5 in the circumferential direction. A locking member 15 is a member that locks a major diameter portion of the snap ring 14. More specifically, the locking member 15 is a substantially ring-shaped member made of metal having a cylindrical portion 15*a* that functions as a locking portion preventing the snap ring 14 from expanding radially and consequently falling off. The locking member 15 is provided between the snap ring 14 and the washer 12 and threaded onto the output shaft 5 to be movable in the axial direction. The minor diameter of the cylindrical portion 15*a* of the locking member 15 is set to a larger dimension than the major diameter of the snap ring 14 fit in the locking groove 5*b*. Further, when the snap ring 14 is locked by the locking member 15, a depth of the locking groove 5*b* in the output shaft 5 is set to be larger than an expansion margin of the snap ring 14 in a case where an expansion of the major diameter thereof is regulated by the locking member 15. In addition, by disposing the cylindrical portion 13*a* of the space collar 13 in the clearance portion in the radial direction between the output shaft 5 and the shift piece 8, the cylindrical portion 13*a* of the space collar 13 is formed as a shielding portion that shields the clearance portion.

The pinion 6 is a member that moves in the axial direction integrally with the output shaft 5 to mesh with a ring gear (not shown) of the engine and starts the engine by rotating integrally with the ring gear. The pinion 6 is splined to the tip end of the output shaft 5 protruding from the front bracket 10. A stopper 16 that regulates a movement of the pinion 6 in the opposite direction to the motor 1 is fixed to the tip end of the output shaft 5 with a snap ring 17. The pinion 6 is pressed toward the stopper 16 by a pinion spring 18.

An operation of the starter according to the first embodiment will now be described. As are shown in FIG. 1 and FIG. 2, the electromagnetic switch 2 is turned ON by an ON operation of the key switch (not shown) and the plunger 2*a* moves in the axial direction toward the motor 1. In association with the movement of the plunger 2*a*, the shift lever 7 starts to swing and the shift piece 8 accordingly moves in the opposite direction to the motor 1. In association with this operation, the shift piece 8 presses the space collar 13 in the opposite direction to the motor 1. As the space collar 13 is pressed, the output shaft 5 moves in the opposite direction to the motor 1. As the output shaft 5 moves in the opposite direction to the motor 1, the pinion 6 engaged with the tip end thereof moves in the opposite direction to the motor 1 and meshes with the ring gear (not shown) of the engine. In this instance, a contact (not shown) in the electromagnetic switch 2 closes and power is fed to the motor 1 and the motor 1 generates a rotational force. The rotational force generated by the motor 1 is reduced by the planetary gear deceleration device 3 and transmitted to the output shaft 5 via the clutch 4. The rotational force is transmitted further to the ring gear via the pinion 6 and the engine starts.

As the key switch is switched OFF because the engine starts, conduction to the electromagnetic switch 2 is cut off. The plunger 2*a* then moves in the axial opposite direction to the motor 1. In association with the movement of the plunger 2*a*, the shift lever 7 swings and the shift piece 8 accordingly moves toward the motor 1. The shift piece 8 presses the washer 12 toward the motor 1. The output shaft 5 moves toward the motor 1 as the washer 12 is pressed. When the output shaft 5 moves toward the motor 1, the pinion 6 demeshes from the ring gear of the engine. In this instance, the contact in the electromagnetic switch 2 goes OFF and power is cut off. The motor 1 thus stops. When the motor 1 stops, the output shaft 5 and the pinion 6 also stop rotating. The starting of the engine by the starter is thus completed.

A description will now be given to the configurations of the output shaft 5, the shift piece 8, the washer 12, the space collar 13, the snap ring 14, and the locking member 15 according to the first embodiment of the invention in accordance with a procedure in which the shift piece 8, the space collar 13, and the like are attached to the output shaft 5.

FIG. 2 shows a state after the components are attached to the output shaft 5. FIG. 5 shows a state after the snap ring 14 is attached to the output shaft 5 and before the shift piece 8 is engaged with the output shaft 5. Initially, as is shown in FIG. 5, the space collar 13, the washer 12, and the locking member 15 are threaded onto the output shaft 5 sequentially in this order from the side of the motor 1 of the axial regulation flange 5*a* provided to the output shaft 5 and the snap ring 14 is fit in the locking groove 5*b* in the output shaft 5 finally. In this instance, the space collar 13, the washer 12, and the locking member 15 are threaded onto the output shaft 5 in a loose-fit state.

In the configuration as above, the axial length (indicated by a capital A of FIG. 2) of the locking member 15 to regulate expansion of the major diameter of the snap ring 14 is set shorter than an axial movable length (indicated by a capital B of FIG. 2) of the locking member 15 before the shift piece 8 is engaged with the output shaft 5. Owing to this setting, as is shown in FIG. 5, in a case where the snap ring 14 is fit in the locking groove 5*b* when the starter is assembled or disassembled, by moving the locking portion 15 in the opposite direction to the motor 1, it becomes possible to fit the snap ring 14 in the locking groove 5*b* without the snap ring being interfered with the locking member 15. Hence, attaching and removing workability of the snap ring 14 is not deteriorated.

As is shown in FIG. 2, as the shift piece 8 engages with the clearance portion between the space collar 13 and the washer 12, the washer 12 and the locking member 15 in the state shown in FIG. 5 are pushed by the shift piece 8 and move toward the motor 1. The major diameter of the snap ring 14 is then locked by the minor diameter of the cylindrical portion 15*a* of the locking member 15. Herein, the starter is configured in such a manner that there is a predetermined clearance (indicated by a capital C of FIG. 2) when the shift piece 8 engages between the space collar 13 and the washer 12 and this clearance is set to be smaller than the dimension A. Accordingly, while the shift piece 8 is engaged between the space collar 13 and the washer 12, even when the locking member 15 moves with axial displacement of the dimension C, the snap ring 14 does not come out completely from the locking member 15. It thus becomes possible to prevent a fall-off of the snap ring 14 in a reliable manner while the starter is operating.

At a position at which the shift piece 8 engages with the output shaft 5, the cylindrical portion 13*a* of the space collar 13 is disposed between the output shaft 5 and the shift piece 8 in a rotatable manner relatively with respect to the output shafts. Hence, the cylindrical portion 13*a* prevents the output shaft 5 rotating at a high speed from coming into contact with the shift piece 8 that does not rotate in the rotation direction of the output shaft 5. It thus becomes possible to suppress wearing of the shift piece 8 caused by friction with the output shaft 5. In addition, by forming the starter in such a manner that there is a clearance between the major diameter portion of the cylindrical portion 13*a* of the space collar 13 and the shift piece 8, it also becomes possible to suppress friction between the shift piece 8 and the space collar 13, which can in turn suppress wearing of the shift piece 8. Further, because the cylindrical portion 13*a* of the space collar 13 is disposed between the space collar 13 and the washer 12, there is at least a clearance as long as the axial length of the cylindrical portion 13*a* before the shift piece 8 is engaged between the space collar 13 and the washer 12. This configuration facilitates engagement of the shift piece 8.

In this embedment, the cylindrical portion 13*a* is provided to the space collar 13. It should be appreciated, however, that the same advantages of suppressing wearing of the shift piece 8 can be achieved when a cylindrical portion is provided to the washer 12.

In the first embodiment, as is shown in FIG. 4A, an opening end that forms substantially U-shaped openings 8*c* provided to tip ends 8*b* of the shift piece 8 is a region that is engaged first between the space collar 13 and the washer 12. The opening end of the openings 8*c* is chamfered to form an engaging guide playing a role of a guide for engagement of the shift piece 8. Consequently, an axial length (indicated by a capital D of FIG. 4A) of the tip ends 8*b* becomes shorter than an axial length (indicated by a capital E of FIG. 5) of the clearance portion between the space collar 13 and the washer 12 before the shift piece 8 is engaged therebetween. The shift piece 8 can be therefore engaged between the space collar 13 and the washer 12 while expanding the clearance portion therebetween. Hence, the shift piece 8 can be readily engaged between the space collar 13 and the washer 12.

Further, as are shown in FIG. 3A and FIG. 3B, the shift piece 8 is configured in such a manner that pressing portions 8*d* pressing the space collar 13 and the washer 12 are supported in a rotatable manner on the two legs 7*e* and 7*f* of the lever 7*a* via the protrusions 8*a* of the shift piece 8. Hence, when the shift piece 8 moves the space collar 13 in the opposite direction to the motor 1 and the washer 12 toward the motor 1, stable pressing can be ensured without reducing contact surfaces between the shift piece 8 and the respective space collar 13 and washer 12.

In this embodiment, the pressing surface, which is a plane forming the pressing portions 8*d* of the shift piece 8, is formed substantially in the shape of a capital U. Owing to this configuration, it becomes possible to secure a wider area for the pressing portion 8*d*. Hence, because a surface pressure of the pressing portions 8*d* can be reduced, durability of the shift piece 8 can be enhanced. Further, a starter of the structure in the related art in which the shift piece 8 and the output shaft 5 are coupled to each other, it is impossible to decouple the shift piece 8 and the output shaft 5 from each other unless the snap ring 14 is removed. In contrast, because the shift piece 8 of this embodiment has the substantially U-shaped openings 8*c* in the pressing surface, the shift piece 8 can be disengaged from the output shaft 5 through the openings 8*c* even when the snap ring 14 is attached to the output shaft 5. Accordingly, because the shift piece 8 can be disengaged from the output shaft 5 before the snap ring 14 is removed when the starter is disassembled, workability can be enhanced.

In addition, as is shown in FIG. 3B, a radial width (indicated by a capital F of FIG. 3B) of the opening end of the substantially U-shaped openings 8*c* provided at the tip ends 8*b* of the shift piece 8 that is first engaged with the clearance portion between the space collar 13 and the washer 12 is narrower than the shaft diameter of the output shaft 5 at the engaging position. Also, inner stress of the shift piece 8 when the substantially U-shaped openings 8*c* of the shift piece 8 are pushed apart to engage the shift piece 8 with the output shaft 5 falls within an elastic range. In this embodiment, it becomes easier to engage and disengage the shift piece 8 with and from the clearance portion between the space collar 13 and the washer 12 by forming the shift piece 8 substantially in the shape of a capital U. This configuration, however, makes it easy for the shift piece 8 to fall off from the clearance portion when the starter is assembled or disassembled. It should be noted that the shift piece 8 configured as above has the fall-out preventing structure with respect to the output shaft 5. Hence, the starter of the first embodiment can ensure as good workability as that of the existing starter having the structure in which the shift piece 8 and the output shaft 5 are coupled to each other.

Second Embodiment

Figure 6:
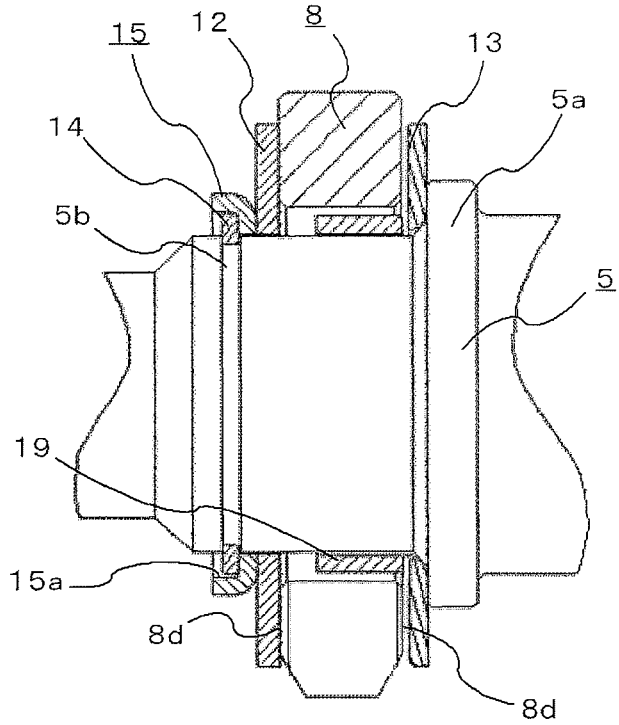
FIG. 6 is a cross section of a major portion after a shift piece is incorporated into a starter according to a second embodiment of the invention.

FIG. 6 is a cross section of a major portion after a shift piece 8 is incorporated into a starter according to a second embodiment of the invention. The second embodiment is different from the first embodiment above in that a spacer 19, which is a different member from the space collar 13, is disposed instead of the cylindrical portion 13*a* of the space collar 13. The starter according to the second embodiment of the invention is of the same structure as that of the starter shown in FIG. 2 except that the spacer 19 and the space collar 13 shown in FIG. 6 and a detailed description of the same structure is omitted herein.

As is shown in FIG. 6, the space collar 13 is a substantially ring-shaped member made of metal and the spacer 19 is a cylindrical member made of metal. An attachment procedure of the respective components in this case is as follows. That is, the space collar 13, the spacer 19, the washer 12, and the locking portion 15 are threaded onto the output shaft 5 sequentially in this order from the side of the motor 1 of the axial regulation flange 5*a* provided to the output shaft 5 and the snap ring 14 is fit in the locking groove 5*b* in the output shaft 5 finally. The procedure thereafter is the same as the procedure of the first embodiment above and a description thereof is omitted herein.

According to this configuration, by providing the spacer 19, the spacer 19 functions as a shielding portion that shields the clearance portion between the output shaft 5 and the shift piece 8. It thus becomes possible to prevent the output shaft 5 rotating at a high speed from coming into contact with the shift piece 8 that does not rotate in the rotation direction of the output shaft 5. Hence, wearing of the shift piece 8 caused by friction with the output shaft 5 can be suppressed. Also, because there is a clearance at least as long as the axial length of the spacer 19 between the space collar 13 and the washer 12, the shift piece 8 can be engaged therebetween with ease. Further, in a case where the space collar 13 and the spacer 19 are provided separately, because each is of a simple structure in contrast to the substantially ring-shaped space collar 13 having the cylindrical portion 13*a* of the first embodiment above, there can be achieved an advantage that each can be worked easily.

Figure 7A:
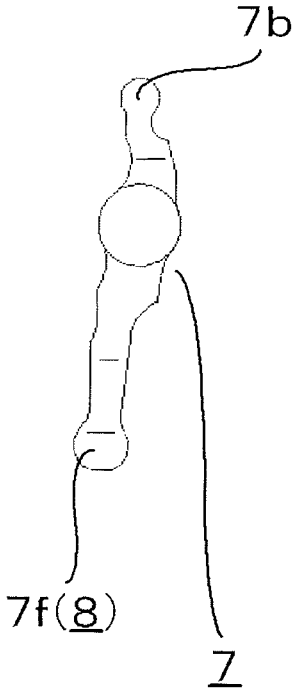
FIG. 7A is a side view of a shift lever as a modification of the invention.
Figure 7B:
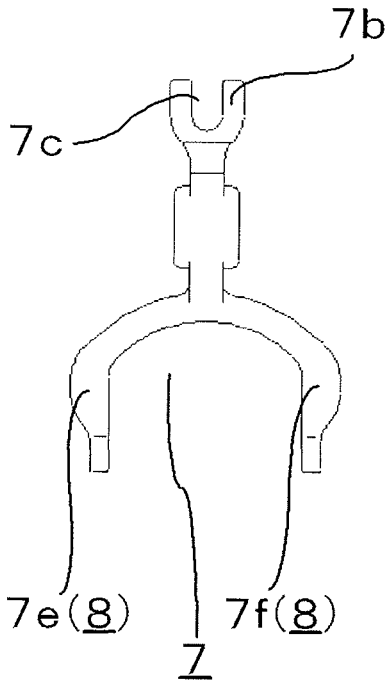
FIG. 7B is a front view of the shift lever of FIG. 7A.

The respective embodiments above have described a case where the shift lever 7 and the shift piece 8 are separate members. However, the invention is also applicable to a case as shown in FIG. 7A and FIG. 7B where the two legs 7*e* and 7*f* of the shift lever 7 are formed integrally with the shift piece 8. In this case, because the need to provide the shift piece 8 as a different member is eliminated, not only can the weight of the shift lever 7 be reduced, but also the configuration of the shift lever 7 can be simpler.

In the respective embodiments above, the washer 12 and the locking member 15 are provided as separate members. However, in a case where these components are provided as one unit, it becomes possible to reduce the number of components and hence the number of assembling steps of the starter.

In addition, a pressed portion pressed by the shift piece 8 can be formed by forming the axial regulation flange 5*a* provided to the output shaft 5 to be long in the radial direction.

Then, the space collar 13 can be omitted. Hence, it becomes possible to reduce the number of components and hence the number of assembling steps of the starter.

Further, in the respective embodiments above, the shift piece 8 alone was described as an example of the member engaged between the space collar 13 and the washer 12. It should be appreciated, however, that this member is not limited to the shift piece 8 and can be any member capable of moving the locking member 15 in the axial direction. The same advantages can be achieved even when the starter includes a member engaged between the space collar 13 and the washer 12 together with the shift piece 8.

Furthermore, in the respective embodiments above, the space collar 13 and the washer 12 alone were described as the members pressed by the shift piece 8. However, in order to suppress wearing of the shift piece 8 caused by friction occurring at a point at which the shift piece 8 comes into contact with the rotating output shaft 5, another washer member may be additionally provided between the shift piece 8 and the space collar 13 or between the locking member 15 and the washer 12 as the necessity arises.

The respective embodiments above described the starter having a pinion cantilever structure (a so-called overhung structure) in which the tip end of the output shaft 5 on the side of the pinion 6 is not supported on the front bracket 10 and the rotation shaft 1*a* of the motor 1 and the pinion 6 are disposed on the same axis. It should be appreciated, however, that the invention is not necessarily formed in this manner and the same advantages can be achieved when the invention is applied to a starter of a pinion both-ends support structure in which the output shaft 5 is supported on the front bracket 10 and a structure in which the motor 1 and the pinion 6 are disposed axially in parallel and engaged with each other using an idle gear.

Various modifications and alterations of this invention will be apparent to those skilled in the art without departing from the scope and spirit of this invention, and it should be understood that this is not limited to the illustrative embodiments set forth herein.

What is claimed is:

1. A starter, comprising:

a motor that generates a rotational force;

an output shaft that rotates with the rotational force transmitted thereto;

a snap ring that is fit in a locking groove provided to the output shaft in a circumferential direction;

a first pressed body that is inhibited from moving in one axial direction by the snap ring;

a second pressed body that is provided to the output shaft and defines a clearance portion together with the first pressed body by opposing the first pressed body in an axial direction;

an engaging member that is engageable with and disengageable from the clearance portion after the snap ring is fit in the locking groove and includes at least a shift lever that moves the output shaft in the axial direction by pressing one of the first and second pressed bodies in the axial direction when engaged with the clearance portion;

a pinion that meshes with a ring gear of an engine by moving in the axial direction integrally with the output shaft and starts the engine by rotating integrally with the ring gear; and a locking portion that is disposed between the snap ring and the shift lever to be movable on the output shaft and locks at least a part of an outer circumference portion of the snap ring when the engaging member is engaged with the clearance portion, wherein an axial length (A) of the locking portion is shorter than an axial movable length (B) of the locking portion when the snap ring is fit in and removed from the locking groove and longer than the axial movable length (C) of the locking portion when the engaging member is engaged with the clearance portion.

2. The starter according to claim 1, further comprising:

a shielding portion that shields at least a part of a clearance in a radial direction between the output shaft and the shift lever and is allowed to rotate relatively with respect to the output shaft.

3. The starter according to claim 2, wherein:

the shielding portion is provided to at least one of the first and second pressed bodies.

4. The starter according to claim 1, further comprising:

an engaging guide that is provided at a tip end of the shift lever and guides the shift lever to an engaging position in the clearance portion, wherein an axial length (D) of the engaging guide is shorter than an axial length (E) of the clearance portion between the space collar and the washer before the shaft piece is engaged therebetween.

5. The starter according to claim 1, further comprising:

a pressing portion of the shift lever that is provided in a rotatable manner with respect to the shift lever and presses one of the first and second pressed bodies.

6. The starter according to claim 5, wherein:

a plane forming the pressing portion of the shift lever is formed substantially in a shape of capital U.

7. The starter according to claim 6, wherein:

a radial width of an opening end forming an opening substantially in the shape of a capital U is narrower than a shaft diameter of the output shaft with which the opening is engaged and stress applied on the opening when the engaging member is engaged with the opening falls within an elastic range of the pressing portion.

* * * * *